US006978644B1

(12) United States Patent
Taper

(10) Patent No.: US 6,978,644 B1
(45) Date of Patent: Dec. 27, 2005

(54) LOCKING MECHANISM FOR HANDCUFFS

(76) Inventor: William D. Taper, P.O. Box 518, Southern Pines, NC (US) 28388

( * ) Notice: Subject to any disclaimer, the term of this patent is extended or adjusted under 35 U.S.C. 154(b) by 200 days.

(21) Appl. No.: 10/766,235

(22) Filed: Jan. 28, 2004

Related U.S. Application Data

(63) Continuation-in-part of application No. 10/394,668, filed on Mar. 21, 2003, now Pat. No. 6,684,666, which is a continuation-in-part of application No. 10/091,272, filed on Mar. 5, 2002, now Pat. No. 6,568,224.

(51) Int. Cl.[7] ..... E05B 75/00
(52) U.S. Cl. ..... 70/16; 70/277
(58) Field of Search ..... 70/16, 277

(56) References Cited

U.S. PATENT DOCUMENTS 29,495 A 8/1860 Kimball
33,917 A 12/1861 Delestatius
35,578 A 6/1862 Adams
130,872 A 8/1872 Runquist
172,476 A 1/1876 Palmer
200,950 A 3/1878 Tower et al.

(Continued)

OTHER PUBLICATIONS

Bi–Directional Latching Solenoid, Magnetic Sensor Systems, Jul. 23, 2003, 14 pages.

*Primary Examiner*—Suzanne Dino Barrett
(74) *Attorney, Agent, or Firm*—Thomas R. Weaver

(57) ABSTRACT

A solenoid operated mechanical mechanism for controlling the rotation of a gear comprising the use of a first linear element which moves in response to an electrical current to cause the rotation of a cam which, in turn, causes the movement of a second linear element which controls the rotation of a gear. The solenoid operated mechanical mechanism is particularly useful for controlling the opening and closing movements of a handcuff whose operating elements are comprised of a swing arm and at least one gear having teeth which engage the teeth of the swing arm.

12 Claims, 9 Drawing Sheets

U.S. PATENT DOCUMENTS

| | | | | | |
|---|---|---|---|---|---|
| 222,252 | A | | 12/1879 | Daley | |
| 222,751 | A | | 12/1879 | Tower et al. | |
| 268,171 | A | | 11/1882 | Bean | |
| 268,496 | A | | 12/1882 | Kahlke et al. | |
| 298,158 | A | | 5/1884 | Bean | |
| 356,215 | A | | 1/1887 | Tower | |
| 372,510 | A | | 11/1887 | Bean | |
| 470,869 | A | | 3/1892 | Kahlke | |
| 623,984 | A | | 5/1899 | Cobb | |
| 636,589 | A | | 11/1899 | Tower | |
| 686,626 | A | | 11/1901 | Maltby | |
| 732,417 | A | | 6/1903 | Judd | |
| 766,263 | A | | 8/1904 | Judd | |
| 772,468 | A | | 10/1904 | Maltby | |
| 1,000,666 | A | | 8/1911 | Caveney | |
| 1,157,135 | A | | 10/1915 | Wesson et al. | |
| 1,161,562 | A | | 11/1915 | Wesson | |
| 1,205,861 | A | * | 11/1916 | Cushing | 70/210 |
| 1,509,335 | A | | 9/1924 | Bockin | |
| 1,579,333 | A | | 4/1926 | Neal | 70/16 |
| 1,742,963 | A | * | 1/1930 | McGlynn | 70/239 |
| 1,775,727 | A | | 9/1930 | Latou | |
| 1,845,511 | A | | 2/1932 | Neal | |
| 1,856,427 | A | | 5/1932 | Pratt | 70/16 |
| 1,872,857 | A | | 8/1932 | Wesson et al. | |
| 1,881,577 | A | | 10/1932 | Hillyard | |
| 1,890,748 | A | | 12/1932 | Pratt | 70/16 |
| 1,900,242 | A | | 3/1933 | Latou | |
| 1,984,677 | A | | 12/1934 | Harrington | |
| 2,390,885 | A | | 12/1945 | Kelley | 70/16 |
| 2,510,294 | A | | 6/1950 | Rivolier | 70/16 |
| 3,392,554 | A | | 7/1968 | Williamson | 70/16 |
| 3,468,143 | A | * | 9/1969 | Douglas et al. | 70/277 |
| 3,616,665 | A | | 11/1971 | Rosenthal | 70/16 |
| 3,618,345 | A | | 11/1971 | Smith | 70/16 |
| 3,733,861 | A | * | 5/1973 | Lester | 70/153 |
| 4,287,731 | A | | 9/1981 | Kruger | 70/16 |
| 4,314,466 | A | | 2/1982 | Harris | 70/16 |
| 4,509,346 | A | | 4/1985 | Szczepanek | 70/16 |
| 4,574,600 | A | | 3/1986 | Moffett | 70/16 |
| 4,620,677 | A | * | 11/1986 | Nagao et al. | 242/385 |
| 4,694,666 | A | | 9/1987 | Bellingham et al. | 70/16 |
| 4,972,784 | A | * | 11/1990 | Ing-Hsiang | 109/3 |
| 4,977,614 | A | * | 12/1990 | Kurcbart | 455/193.1 |
| 5,099,662 | A | * | 3/1992 | Tsai | 70/16 |
| 5,138,852 | A | | 8/1992 | Corcoran | 70/16 |
| 5,265,452 | A | * | 11/1993 | Dawson et al. | 70/278.3 |
| 5,307,656 | A | * | 5/1994 | Gartner et al. | 70/277 |
| 5,426,961 | A | * | 6/1995 | Rimbaud et al. | 70/237 |
| 5,487,290 | A | * | 1/1996 | Miller et al. | 70/303 A |
| 5,598,723 | A | | 2/1997 | Ecker et al. | 70/16 |
| 5,697,231 | A | | 12/1997 | Tobin et al. | 70/16 |
| 5,797,284 | A | | 8/1998 | Lurie | 70/16 |
| 6,141,997 | A | * | 11/2000 | Blehi, III | 70/56 |
| 6,158,297 | A | * | 12/2000 | Polosky et al. | 74/414 |
| 6,230,862 | B1 | * | 5/2001 | Reik et al. | 192/3.56 |
| 6,279,361 | B1 | * | 8/2001 | Baukholt et al. | 70/279.1 |
| 6,311,529 | B1 | | 11/2001 | Kang | 70/16 |
| 6,371,536 | B1 | * | 4/2002 | Koerwer et al. | 292/201 |
| 6,513,351 | B2 | * | 2/2003 | Clark | 70/101 |
| 6,568,224 | B1 | * | 5/2003 | Taper et al. | 70/16 |
| 6,615,622 | B2 | * | 9/2003 | MacAleese et al. | 70/16 |
| 6,619,077 | B1 | * | 9/2003 | Robinson | 70/16 |
| 6,629,440 | B1 | * | 10/2003 | Meekma et al. | 70/49 |
| 6,672,116 | B1 | * | 1/2004 | Hilliard | 70/16 |
| 6,684,666 | B1 | * | 2/2004 | Taper | 70/16 |

* cited by examiner

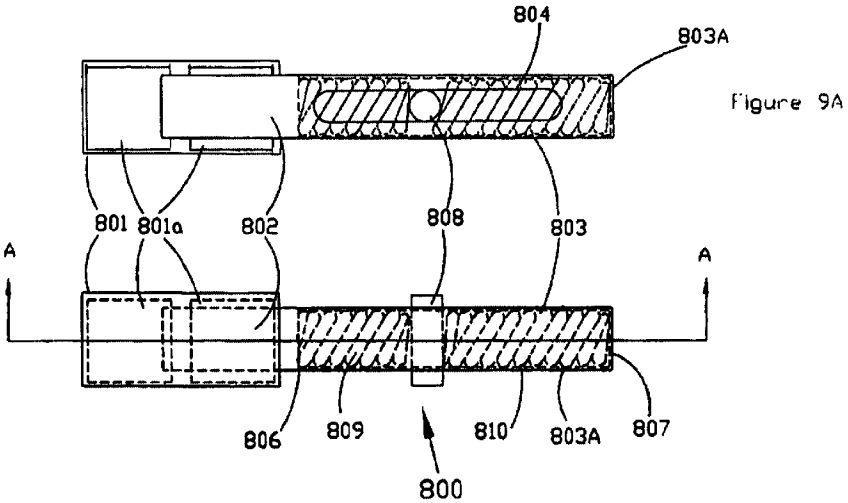
Figure 9A
Figure 9
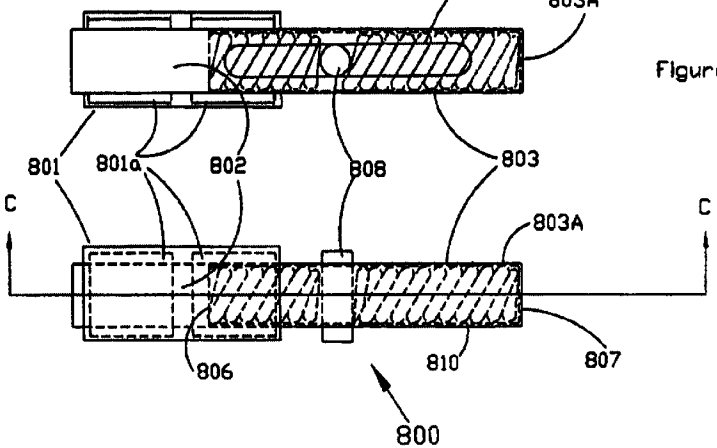
Figure 10A
Figure 10

LOCKING MECHANISM FOR HANDCUFFS

This is a continuation-in-part of U.S. application Ser. No. 10/394,668 filed Mar. 21, 2003, now U.S. Pat. No. 6,684,666 issued Feb. 3, 2004, which is a continuation-in-part of U.S. application Ser. No. 10/091,272 filed Mar. 5, 2002, now U.S. Pat. No. 6,568,224 issued May 27, 2003.

BACKGROUND OF THE INVENTION

1. Technical Field of the Invention

This invention broadly relates to locking devices. This invention more particularly relates to mechanical restraining devices referred to in the art as "handcuffs." This invention specifically relates to a locking mechanism for a handcuff.

2. Description of the Prior Art and Problems Solved

In the interest of brevity, the disclosures of U.S. Pat. No. 6,568,224 and U.S. application Ser. No. 10/394,668, mentioned above, are incorporated herein by reference. The Patent and the Application each include a discussion of the prior art relating to handcuffs and to problems involved with prior art handcuffs. The Patent and the Application provide a solution for the described problems which solution, in brief, is a novel operating mechanism comprising at least one gear in operable combination with a swing arm and a mechanical locking mechanism which operates to permit, as well as to prevent, the rotation of the gears and related movement of the swing arm. The Patent and the Application also include definitions of terms which apply herein.

In view of the problems involving the operating and locking mechanisms of handcuffs of the prior art, the Patent and the Application provide a handcuff wherein a gear in the operating mechanism is at all times in full contact and intermeshed with teeth on the swing arm when the handcuff is being either opened or closed and wherein a mechanical locking mechanism permits or prevents movement of the gears in the operating mechanism.

It is the object of this invention to provide a handcuff having an electro-mechanical locking mechanism which can be remotely operated with an electronic key.

These and other objects, advantages and features provided by this invention will become apparent to those persons skilled in the art from a consideration of the following description and drawings which describe the apparatus of this invention and the manner and process of making and using the same.

THE INVENTION

1. SUMMARY OF THE INVENTION

In one aspect, this invention provides an apparatus and a method of using the apparatus to control the rotation of a gear around a hub. The apparatus is comprised of a cam and an arm, referred to as the actuation arm, which operate in combination to move a rod which is adapted to contact the teeth of the gear. The cam is a flat, preferably substantially circular, plate which is attached to an axle. The axle, referred to as the cam axle, is perpendicularly fixed to a planar base. The plate is adapted to rotate around the axle in a plane which is parallel to the base. The hub, mentioned above, is, preferably, perpendicularly fixed to the same planar base as the mentioned axle. The gear is adapted to rotate around the hub in a plane which is parallel to the base.

The plate includes a first slot and a first groove. The first slot, referred as the cam slot, perpendicularly passes through the plate from the top surface to the bottom surface. The first groove, referred to as the cam groove, is formed between the top surface and the bottom surface of the plate. The plate further includes two shoulders for engaging and moving a lever positioned between the shoulders. The lever is attached to the rod which is slidably attached to the mentioned base.

The first slot extends radially from the edge of the plate toward the axle. The first groove is formed in at least a peripheral portion of the plate between the top surface and the bottom surface of the plate and extends from the edge of the plate toward the axle. The first groove intersects the first slot.

The arm is comprised of a cylinder and a housing. The housing has two open ends and a hollow interior. It is fixed to the planar base and positioned on the base so that there is no contact between the housing and the plate, and so that the cylinder may slidably move in the first groove, which, as mentioned, is formed between the top surface and the bottom surface of the plate. The housing contains at least one coil in the hollow interior thereof. The coil is of the type adapted to conduct an electric current.

The cylinder includes a solid portion and a hollow portion having a closed end. The solid portion of the cylinder, which is referred to as the plunger, is adapted to longitudinally slide within the coils in the hollow interior of the housing. The plunger enters the housing by way of the mentioned open ends.

The hollow portion of the cylinder contains a second slot, referred to as the arm slot. The second slot is formed in opposite walls of the hollow portion of the cylinder. To be more specific, the second slot is actually two slots in alignment. The second slot is parallel to the longitudinal axis of the cylinder and intersects the first slot when the cylinder is slidably positioned in the first groove. A first biasing spring, a second biasing spring and a pin are positioned in the hollow portion of the cylinder adjacent to the second slot. The first biasing spring abuts the solid portion of the cylinder (the plunger) and the second biasing spring abuts the closed end of the hollow portion of the cylinder. The pin, referred to as the cam pin, is positioned perpendicularly to the longitudinal axis of the cylinder between the first biasing spring and the second biasing spring. The pin is of sufficient length to pass through the entire hollow portion of the cylinder and so that it extends from the second slot into the first slot. The pin functions as the physical contact between the cam and the arm. Linear movement of the cylinder causes rotational movement of the cam because of the contact between the pin and the cam in the first slot This invention has been thus generally described. It shall, hereafter, be more specifically described in terms of an apparatus useful in the operation of a set of handcuffs. Accordingly, this invention provides an apparatus useful as a handcuff which, with two additions, is described in U.S. Pat. No. 6,568,224 and U.S. application Ser. No. 10/394,668, which is a continuation-in-part of the mentioned patent.

The first addition is a bi-directional solenoid with an associated power source and a UHF receiver. The second addition is a cam which is moved by the bi-directional solenoid. The two additions, in combination with a UHF RF transmitter, permit the handcuff to be locked and unlocked electronically. The use of a mechanical key is not required, but may be employed.

The handcuff is comprised of a housing having an operating and a locking mechanism enclosed therein. The housing is comprised of at least two, substantially identically shaped, opposed, substantially parallel, plates, and a swing arm. Each plate is a unitary body divided into a first section called a "cheek plate," and a second section called a "plate arm." The plates are spaced apart to provide a machinery space between the cheek plates and a curvilinear stationary arm defined by the plate arms. The space between the terminal ends of the plate arms is referred to as the hinge end of the stationary arm.

The swing arm is an elongated curvilinear body having a pivot end and a free end. The pivot end of the swing arm is rotatably connected to the hinge end of the stationary arm. The swing arm extends in an arc toward the machinery space from the hinge end of the stationary arm. The free end of the swing arm is equipped with teeth adapted to engage, that is, contact and intermesh with, opposing teeth mounted within the machinery space.

The swing arm, the stationary arm, and the inner edges of the opposed cheek plates cooperate to form the restraining space of the handcuff when the free end of the swing arm is rotated into and engaged with teeth mounted in the machinery space.

The operating mechanism is housed in the machinery space. In one embodiment, the operating mechanism of this invention can be a toothed wheel, that is, a gear, whose teeth engage the teeth mounted on the swing arm. In another embodiment, the operating mechanism of this invention can be comprised of two gears, each of whose teeth can simultaneously engage the teeth mounted on the swing arm. In still another embodiment, the operating mechanism of this invention can be comprised of an array of three intermeshing gears having two gears, referred to herein as "working gears," whose teeth can simultaneously engage the teeth mounted on the swing arm, and a third gear, referred to herein as an "idler gear," whose teeth are continually and simultaneously engaged with the teeth on the two working gears. In still another embodiment, the operating mechanism can be comprised of a single working gear and an idler gear.

When the handcuff is being opened or closed, that is, when the restraining space is being opened or closed, teeth mounted on the swing arm are always in contact with teeth on at least one of the working gears. Thus, gear teeth engage teeth of the swing arm (1) when the swing arm is in the closed position and not moving; (2) when the swing arm is being rotated into machinery space to place the handcuff into the closed position; and (3) when the swing arm is being rotated out of the machinery space to place the handcuff in the open position.

Any working gear of the operating mechanism having teeth engaged, that is, in contact and intermeshed, with teeth on the swing arm must rotate to enable any rotational movement of the swing arm.

By this invention there is provided a multifunction electro-mechanical locking mechanism which controls the rotation of the gears. The locking mechanism of this invention is housed in the machinery space in a location separate from the operating mechanism.

The locking mechanism features three locking positions. In the first locking position, referred to herein as the "closing position," the locking mechanism is adjusted to permit rotation of the gears in one direction to permit closing rotation of the swing arm, and to prevent rotation of the gears in the opposite direction to prevent opening rotation of the swing arm. In the second locking position, referred to herein as the "locked position," the locking mechanism is adjusted to prevent any rotation of the gears in any direction to prevent any rotation of the swing arm in any direction. In the third locking position, referred to herein as the "free position," the locking mechanism is adjusted to permit rotation of the gears in any direction to permit rotation of the swing arm in any direction. The operating mechanism includes a linear rod which, in terms of operation, controls rotation of the gears. The linear rod can be positioned to be or not to be in direct contact with a gear.

The operating mechanism of this invention is controlled by the locking mechanism which functions to position the linear rod. The locking mechanism is comprised of a cam and an arm, which is sometimes referred to herein as a bidirectional solenoid activation arm, or more simply, as the actuation arm. The cam is in operable combination with a cam lever which is rigidly attached to the linear rod at a point intermediate the proximal end and the distal end of the linear rod. A cam axle is fixed to at least one cheek plate of the handcuff in the machinery space. The cam rotates around the cam axle in a plane parallel to the cheek plates. The bidirectional solenoid activation arm is mounted in the machinery space, parallel to the cheek plates in a position partially internal to the cam, but separated from the cam axle. The actuation arm is in operable combination with the cam. As mentioned, the cam rotates. The actuation arm has a component, the housing, which does not move, and a component, the cylinder which moves linearly.

The actuation arm is a linear component comprised of two principal elements: a housing, which contains electrical coils, and a cylinder. The cylinder is subdivided into a solid portion, the plunger, and a hollow portion. The housing is fixed in a position which will not interfere with the rotation of the cam, but which will enable the cylinder to slidably move in the cam in a part of the cam called the cam groove, which is described below. The housing has a hollow interior. The coils are mounted in the hollow interior to form loops transverse to the longitudinal axis of the housing. The plunger of the cylinder is adapted to linearly slide through the loops defined by the electrical coils.

The cam is a flat, oval plate having a top surface and a bottom surface. The plate is pierced by a hole, referred to as the axle hole, which is at right angles to the plate. The cam has three distinct operating areas spaced evenly apart around the axle hole. The operating areas include an open area, a slotted area and a closed area.

The open area, sometimes referred to as the forked area of the cam, has a first shoulder on one side of the opening and a second shoulder on the opposite side of the opening. The second shoulder is spaced apart from and is shorter than the first shoulder.

The closed area contains two, spaced-apart, semicircular grooves located on the outer edge of the closed area. The grooves are referred to herein as detents.

The slotted area, located intermediate the closed area and the open area, contains a first linear slot, referred to as the cam slot, and a cam groove. The cam slot extends radially from the edge of the cam toward the cam axle and is comprised of a first side, a second side and an end. The end is located between the cam axle and the edge of the cam and connects the two sides. The cam slot is sized to enable the cam pin, hereinafter described, located in the hollow portion of the cylinder to move in a radial direction as the cam is rotated about the cam axle by linear movement of the cylinder. To be more precise, the cam pin does not actually move toward or away from the cam axle, because the transverse movement of the cam pin is prevented, or at least restricted, by the cylinder. But the distance between the cam axle and the cam pin changes along the cam slot as the cam rotates.

The cam groove, which is variable in depth, is formed in the edge of the slotted area of the cam between the top and bottom surfaces thereof and passes through the slotted area between the closed area and the open area. The top of the groove is the edge of the cam and is, thus, open. The bottom of the groove is closed and is curvilinear. The cam groove intersects the cam slot.

The cylinder component of the actuation arm has a solid portion, the plunger, substantially located within the hollow interior of the housing, and a hollow portion having a closed end. The hollow portion is comprised of a slot, referred to as the arm slot, and contains, in the hollow interior, two biasing springs and a pin, referred to as the cam pin. The cam pin is positioned between the biasing springs. The arm slot, which is actually a pair of aligned slots formed in opposite walls of the hollow portion of the cylinder, penetrates the wall of the cylinder and is parallel to the longitudinal axis of the cylinder.

The hollow portion of the cylinder is partially positioned within the cam groove, and approaches, but does contact, the curvilinear bottom of the groove as the cam rotates. In other words, the bottom of the cam groove does not obstruct the movement of the cylinder as linear motion of the cylinder produces rotational motion of the cam. The cam groove also permits a handcuff key to rotate the cam about the cam axle.

The cam pin connects the actuation arm with the cam and converts linear motion of the cylinder to rotational motion of the cam.

The arm slot is sized to permit the cam pin, which moves in the cam slot, to simultaneously move within the arm slot. The spring biasing means located in the hollow portion of the cylinder position the cam pin in the arm slot.

Passing an electric current through the coil in the housing creates a magnetic force which causes the plunger, which is surrounded by the coil in the housing, to move linearly. Accordingly, the entire cylinder moves linearly parallel to the longitudinal axis of the activation arm. Linear movement of the cylinder and, thus of the cam pin in the cam slot, causes rotation of the cam about the cam axle, which causes contact between the cam lever and one of the first shoulder and second shoulder in the open area which, in consequence, controls rotation of the gear, or gears and the swing arm.

The locking mechanism can be employed in a handcuff having an operating mechanism comprised of at least one working gear, a swing arm and a linear rod, or with an operating mechanism comprised of an idler gear and one or two working gears, a swing arm and a linear rod. Accordingly, the operating mechanism can include a combination of two working gears, a combination of one working gear and an idler gear, or a combination of two working gears and an idler gear. The linear rod can be positioned to contact any of the gears.

The locking mechanism contains means for rotating the cam on the cam axle and detent means for maintaining the position of the cam with respect to the cam lever. In one embodiment, the means for rotating the cam about the cam axle is caused by activation of the bidirectional solenoid operating in response to an electronic signal. Activation of the bidirectional solenoid causes linear motion of the cylinder and the cam pin which rotates the cam about the cam axle, in either an unlocking or locking direction, depending upon mode of activation of the arm.

Activation of the arm in the opening direction produces linear force against the cam pin in the cam slot in an amount sufficient to rotate the cam about the cam axle in the opening direction. Such rotation of the cam causes contact between the cam lever and the inside surface of the first shoulder to thereby linearly urge the rod against the biasing means at the distal end of the rod.

Activation of the arm in the closing direction produces linear force against the cam pin in the cam slot in an amount sufficient to rotate the cam about the cam axle in the closing direction. Such rotation of the cam causes contact between the cam lever and the inside surface of the second shoulder to thereby linearly urge the rod against the teeth of a gear, such the idler gear.

The locking mechanism can further include a power source, comprising a battery, a UHF RF sensor module and a remote UHF RF transmitter. These elements are known and are used in other applications, such as garage door openers and vehicle keyless entry/locking devices. These elements are employed in combination with the cam, the bidirectional solenoid, and activation arm.

The power source and UHF RF sensor module are each mounted in the machinery space of the handcuff. The UHF RF sensor module interprets the received RF signal and causes the bidirectional cam activation solenoid to move in the desired direction. The remote UHF RF transmitter, as the description implies, is not mounted in the handcuff.

In another embodiment, the means for rotating the cam about the cam axle can be a mechanical handcuff key which is inserted into a key way followed by rotation of the key to rotate the cam in the desired direction. The handcuff key can be used as a backup to rotate the cam about the cam axle in the opening rotational direction from the electronically derived closed position. Opening rotation causes the cam pin to travel linearly in the arm slot to compress the biasing spring at the closed end of the hollow cylinder. Such rotation of the cam about the cam axle causes contact between the cam lever and the inside surface of the first shoulder to compress the biasing means al the distal end of the rod.

Rotation of the cam about the cam axle in the closing rotational direction from the electronically derived open position by use of a backup handcuff key causes the cam pin to travel linearly in the arm slot to compress the biasing spring at the plunger end of the hollow portion of the cylinder. Such rotation of the cam about the cam axle causes contact between the cam lever and the inside surface of the second shoulder to urge the rod against the teeth of the idler gear.

2. BRIEF DESCRIPTION OF THE DRAWINGS

FIG. 1 is a three-dimensional representation of a set of handcuffs as described in U.S. Pat. No. 6,568,224, which is sometimes referred to herein as the '224 patent.

FIG. 1*a* is a three-dimensional representation of a key employed to manipulate the locking mechanism of the handcuff shown in FIG. 1.

FIG. 2 is a plan view of a handcuff as described in U.S. Pat. No. 6,568,224 having an exterior plate removed to reveal the swing arm, the interior plate, the machinery spaces, the operating mechanism and the locking mechanism configured in the free position. The reference numerals shown in FIGS. 1, 1*a* and 2 identify features described in the '224 patent.

FIG. 8 shows the open area, closed area, and slotted area of the cam.

Figures 8, 8A:
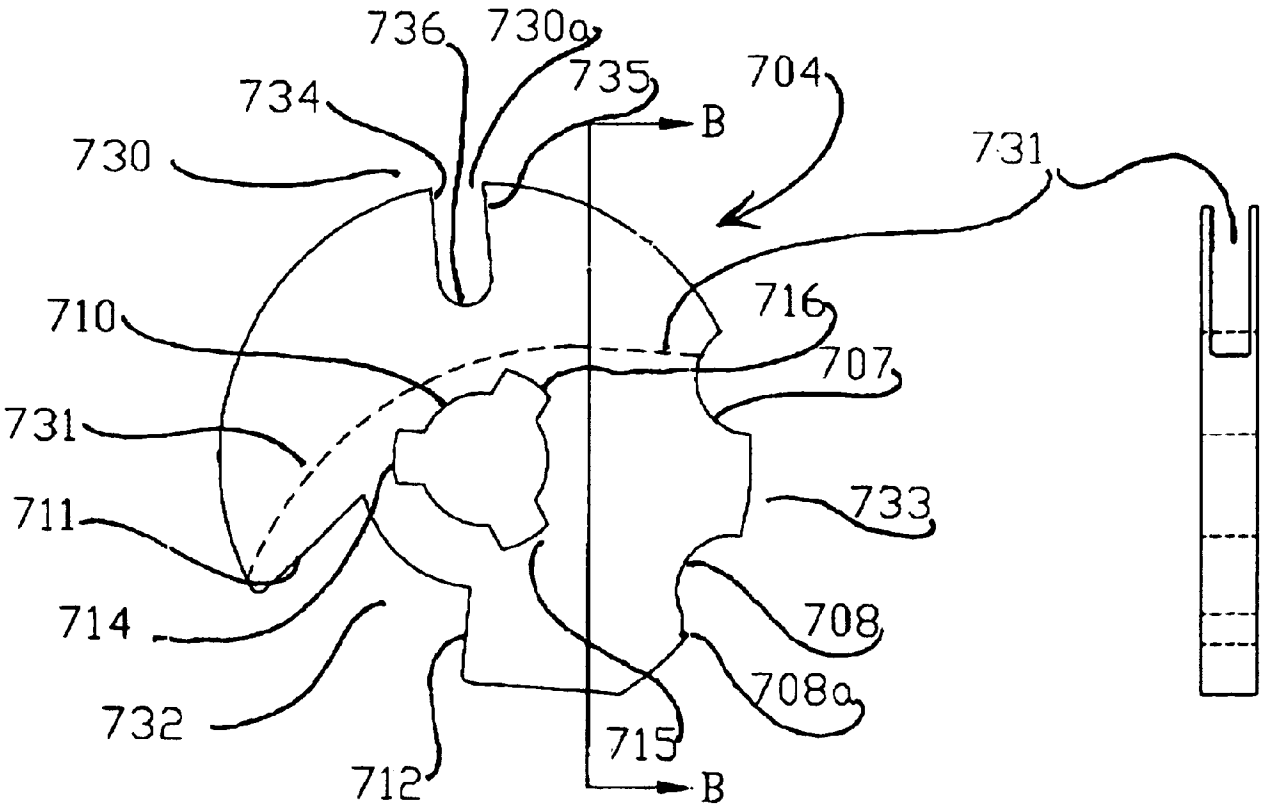
FIG. 8 is an enlarged plan view of the cam of the electro-mechanical locking mechanism shown in FIGS. 3–7.

FIG. 8*a* is a sectional view of FIG. 8 taken in the direction of B—B showing the cam groove.

FIG. 9 is a plan view of the bidirectional solenoid activation arm in the closing position showing the housing, cylinder and cam pin together with the plunger and hollow portion of the cylinder.

FIG. 9*a* is a sectional view taken of FIG. 9 taken in the direction of A—A showing the arm slot.

FIG. 10 is a plan view of the bidirectional solenoid activation arm in the locked position showing the housing, cylinder and cam pin together with the plunger and hollow portion of the cylinder.

FIG. 10*a* is a sectional view taken of FIG. 10 taken in the direction of C—C showing the activation arm slot.

3. DESCRIPTION OF THE PREFERRED EMBODIMENTS

Figure 1A:
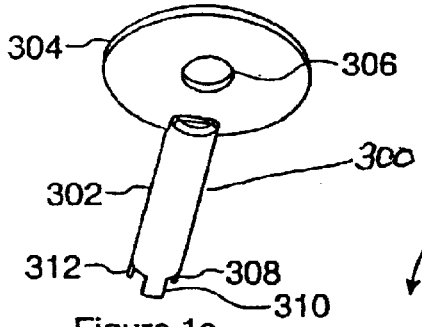
Figure 1:
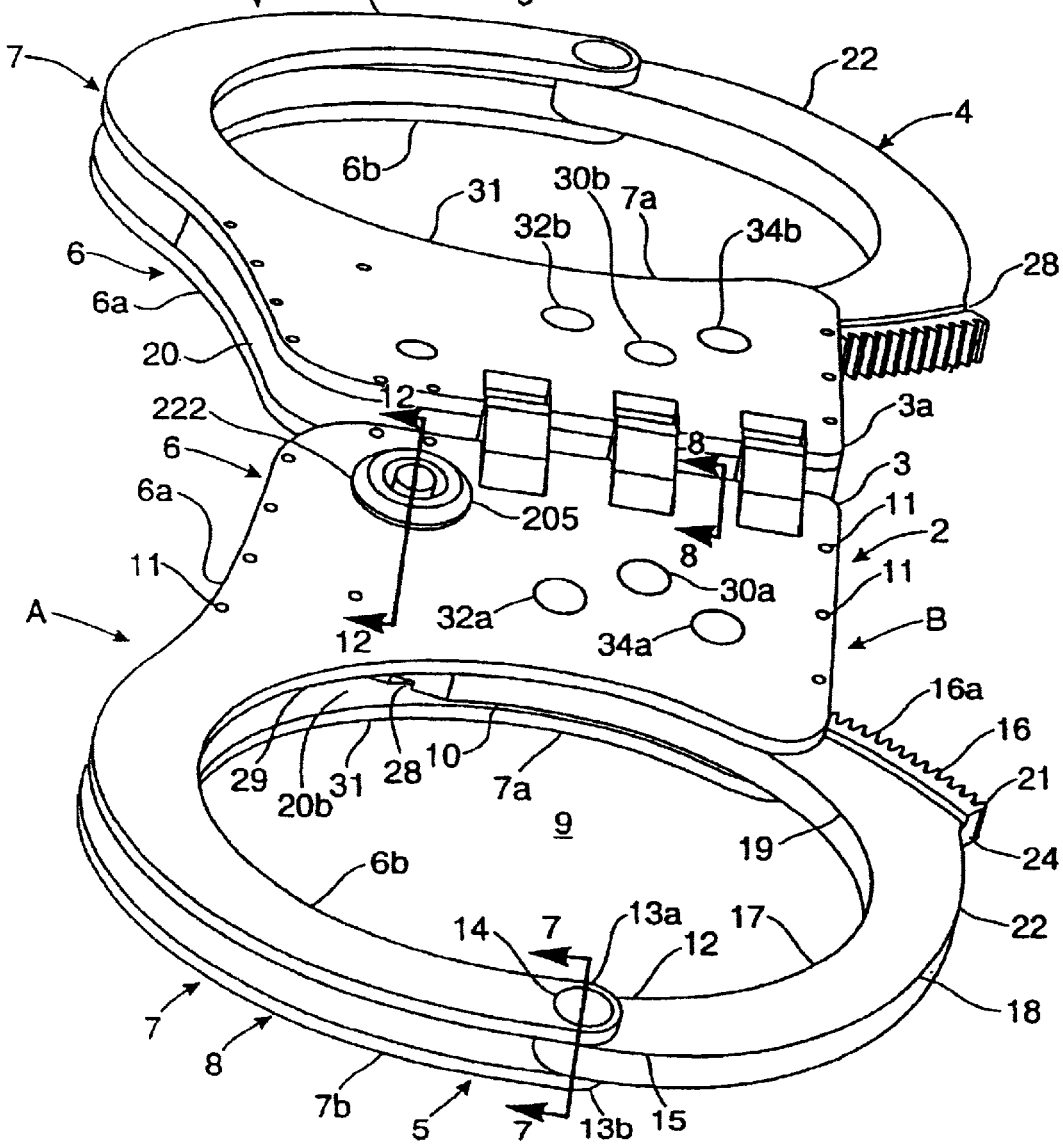

This invention provides an apparatus useful as a handcuff. The apparatus is comprised of a housing having an operating and a locking mechanism enclosed therein, wherein the housing, as shown in FIG. 1, is comprised of at least two, substantially identically shaped, opposed, substantially parallel, plates, 6 and 7, and a swing arm, 22. Each plate is a unitary body having an inside surface, an outside surface, an arm side, A, and an open side, B. Each plate, such as plate 6, for convenience of reference herein, is divided into a first section, 6*a*, referred to as a "cheek plate," and a second section, 6*b*, referred to as a "plate arm." A plate arm is a narrow, elongated, curvilinear part of the plate which extends in an arc from the arm side of the plate to a terminal end on the open side of the plate. The plates are spaced apart to provide a machinery space between the opposed inside surfaces of each cheek plate and a curvilinear stationary arm defined by the spaced, opposed plate arms. The space between the terminal ends of the plate arms is referred to as the hinge end of the stationary arm.

The swing arm, like the stationary arm, is also a narrow, elongated curvilinear body having a pivot end and a free end. The pivot end of the swing arm is positioned between the terminal ends of the plate arms and rotatably connected to the hinge end of the stationary arm. The swing arm extends in an arc toward the open side of each plate from the hinge end of the stationary arm to the free end of the swing arm. The free end of the swing arm is equipped with teeth adapted to engage, that is, contact and intermesh with, opposing teeth mounted within the machinery space.

The swing arm, the stationary arm, and the inner edges of the opposed cheek plates cooperate to form the restraining space of the handcuff when the free end of the swing arm is rotated into and engaged with teeth mounted in the machinery space.

The operating mechanism of this invention is housed in the machinery space between the opposed cheek plates. In one embodiment, the operating mechanism of this invention can be a toothed wheel, that is a gear, whose teeth engage the teeth mounted on the swing arm. In another embodiment, the operating mechanism of this invention can be comprised of two gears, each of whose teeth can simultaneously engage the teeth mounted on the swing arm. In still another embodiment, the operating mechanism of this invention can be comprised of an array of three intermeshing gears having two gears, referred to herein as "working gears," whose teeth can simultaneously engage the teeth mounted on the swing arm, and a third gear, referred to herein as an "idler gear," whose teeth are continually and simultaneously engaged with the teeth on the two working gears. In still another embodiment, the operating mechanism can be comprised of a single working gear and an idler gear.

The description of the operating mechanism, as shown in FIGS. 2–7, is contained in the mentioned '224 patent. In this regard attention is directed to FIGS. 1, 1*a* and 2. Notice that the locking mechanism shown in FIGS. 1, 1*a* and 2 and described in the '224 patent is not the electro-mechanical locking mechanism shown in FIGS. 3–7 which is described herein.

Figure 4:
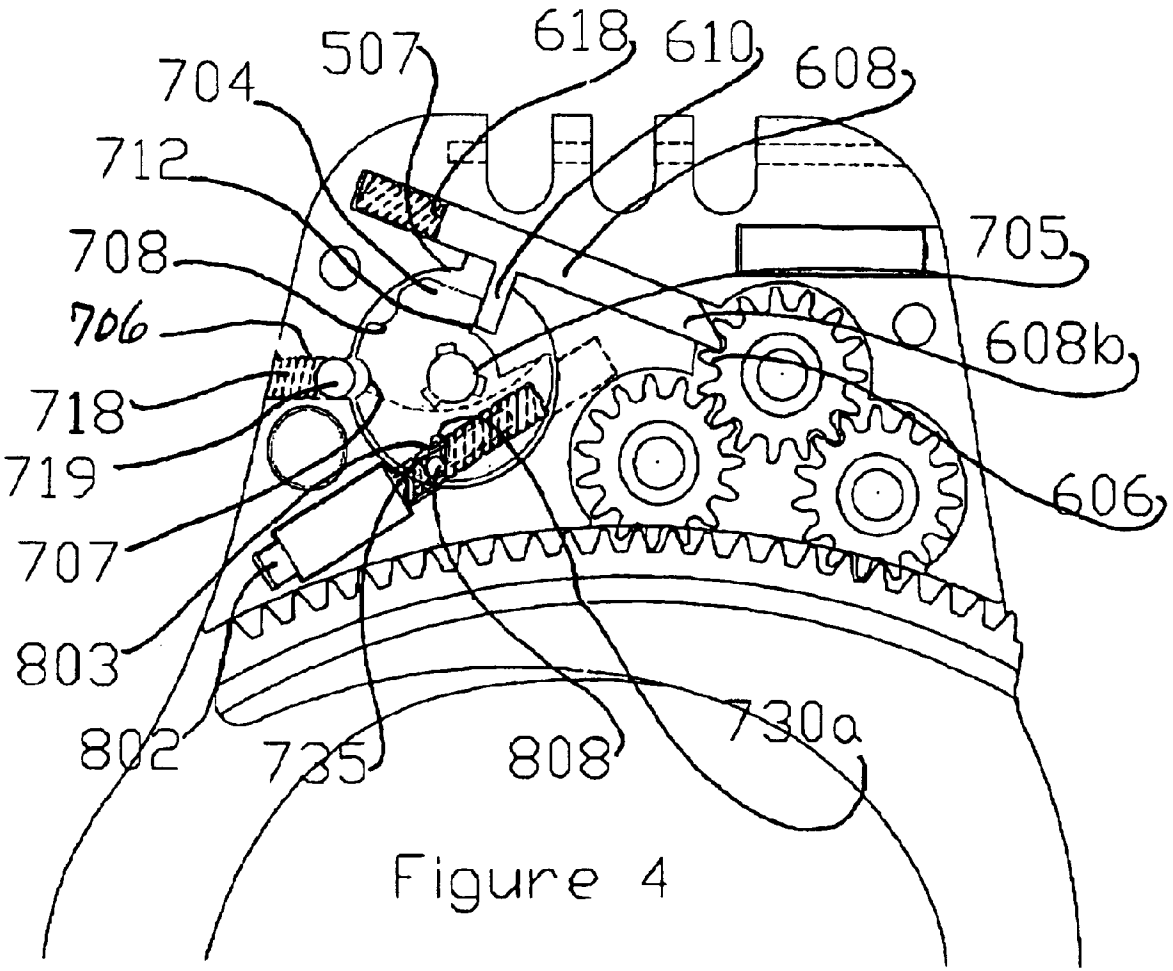
FIG. 4 is a plan view of a handcuff of this invention having an exterior plate removed to reveal a part of the swing arm, interior plate, the machinery spaces, the operating mechanism, and the electro-mechanical locking mechanism configured in the locked position.
Figure 5:
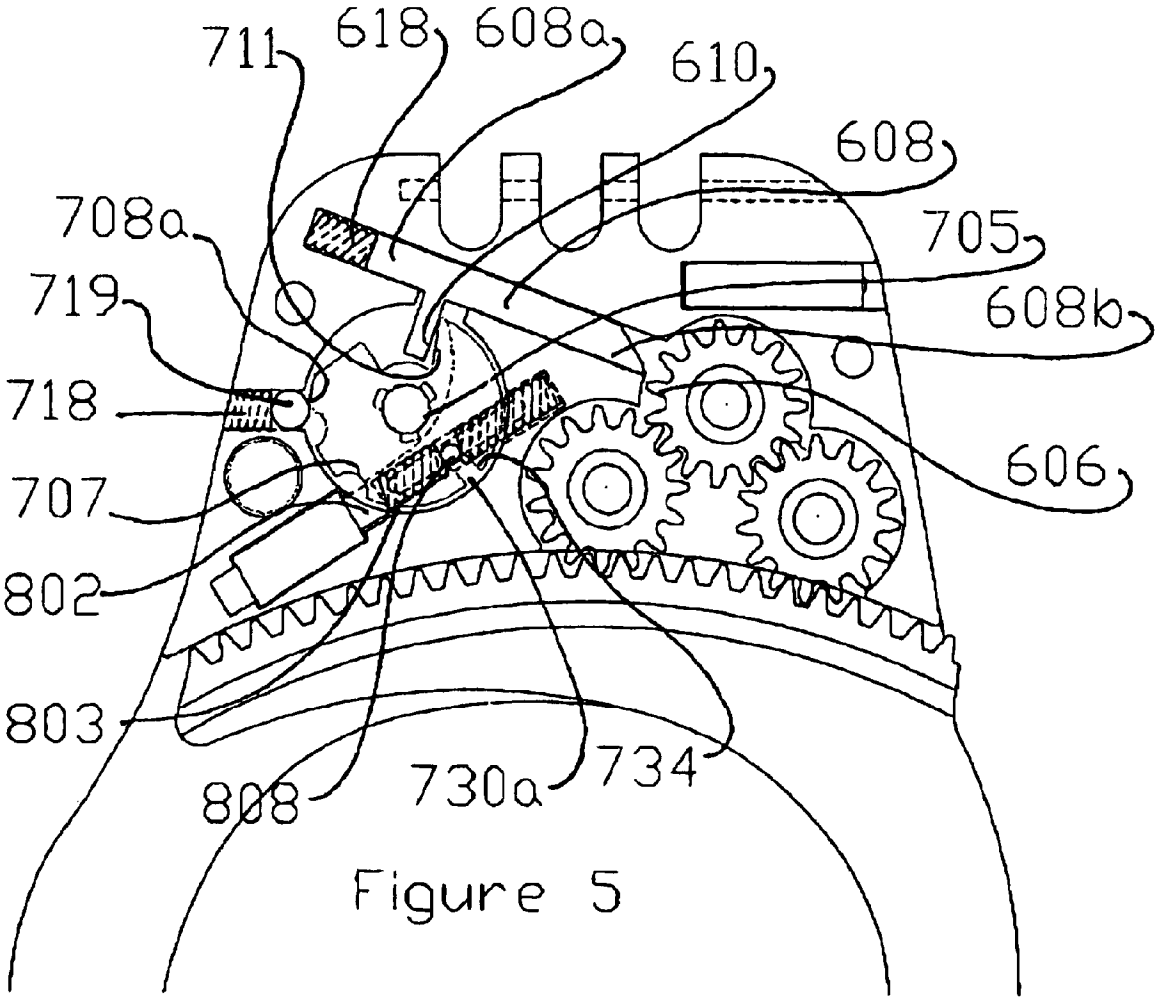
FIG. 5 is a plan view of a handcuff of this invention having an exterior plate removed to reveal a part of the swing arm, interior plate, the machinery spaces, the operating mechanism, and the electro-mechanical locking mechanism configured in the free position. Compare FIG. 2 with FIG. 5.

When the handcuff is being opened or closed, that is, when the restraining space is being opened or closed, teeth mounted on the swing arm are always in contact with teeth on at least one of the working gears. Thus, gear teeth engage teeth of the swing arm (1) when the swing arm is in the locked position and not moving, as shown in FIG. 4, (2) when the swing arm is being rotated toward the arm side of the plates to place the handcuff into the closing position, as shown in FIG. 3, and (3) when the swing arm is being rotated toward the open side of the plates to place the handcuff in a free position, as shown in FIG. 5.

Any working gear of the operating mechanism having teeth engaged, that is in contact and intermeshed, with teeth on the swing arm must rotate to enable any rotational movement of the swing arm. This invention, accordingly, provides a multifunction locking mechanism which controls the rotation of the gears. The locking mechanism of this invention is housed in the machinery space between the opposed cheek plates in a location separate from the operating mechanism.

Figure 3:
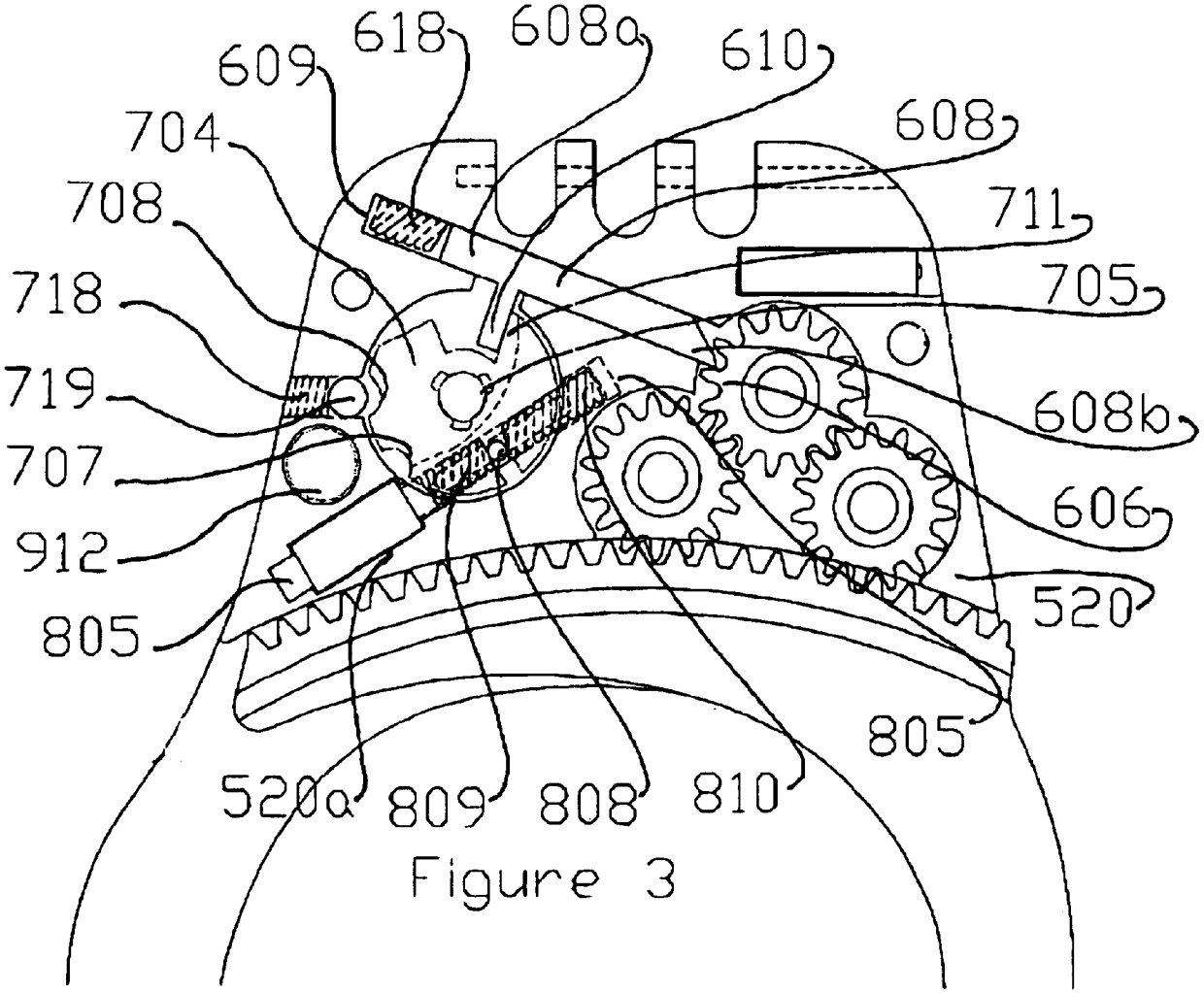
FIG. 3 is a plan view of a handcuff of this invention having an exterior plate removed to reveal a part of the swing arm, interior plate, the machinery spaces, the operating mechanism, and the electro-mechanical locking mechanism configured in the closing position.

In a first position, shown in FIG. 3, referred to herein as the "closing position," the locking mechanism is positioned to permit rotation of the gears in one direction to thereby permit closing rotation of the swing arm, and to prevent rotation of the gears in the opposite direction to prevent opening rotation of the swing arm. In a second position, shown in FIG. 4, referred to herein as the "locked position," the locking mechanism is positioned to prevent any rotation of the gears in any direction to thereby prevent any rotation of the swing arm in any direction. In a third position, shown in FIG. 5, referred to herein as the "free position," the locking mechanism is positioned to permit rotation of the gears in any direction to thereby permit rotation of the swing arm in any direction.

Figure 2:
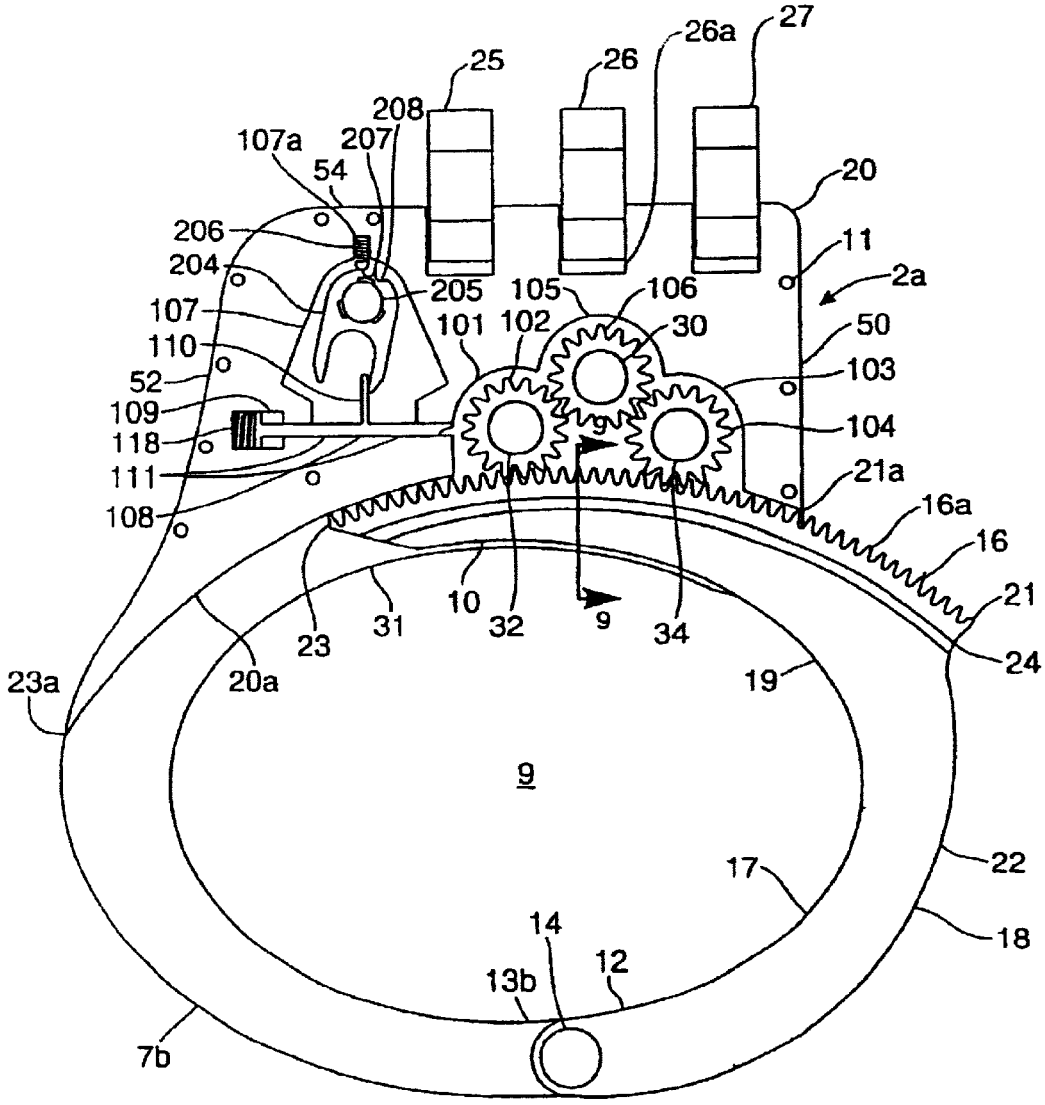

FIG. 2 features an operating mechanism comprised of an array of three intermeshing gears, two working gears, one idler gear, and a control pin, wherein the control pin directly contacts a working gear. The control pin is operated by a mechanical locking mechanism. In contrast, FIGS. 3–7 illustrate an embodiment of this invention also featuring an operating mechanism comprised of an array of three intermeshing gears, two working gears and one idler gear, and a linear rod, wherein the linear rod directly contacts the idler gear. The linear rod is operated by an electro-mechanical locking mechanism. The essential distinction between the embodiment of FIG. 2 and the embodiment of FIGS. 3–7 is the locking mechanism.

As mentioned, the operating mechanism can further include a linear rod comprising a linear rod slidably mounted on, and parallel to, the fixed planar base in the machinery space in a position opposed to a working gear, and preferably perpendicular to the axle of the working gear. In another embodiment, as shown in FIGS. 3–7, the linear rod can be in a position opposed to an idler gear and preferably perpendicular to the axle of the idler gear. The linear rod has a proximal end, a distal end and a biasing means, such as spring, abutting the distal end of the rod to urge the proximal end of the rod into contact with the teeth of the designated gear. The proximal end of the rod is adapted to contact the teeth on the gear to permit rotation of the gear around its axle in one rotational direction while preventing rotation of the gear around its axle in the opposite rotational direction.

The operating mechanism of this invention can be further controlled by a locking mechanism comprised of cam 704, FIG. 8, and bidirectional solenoid 800, FIGS. 9 and 10. Cam 704 is in operable combination with cam lever 610, which is rigidly attached to linear rod 608 at a point intermediate proximal end 608*a* and distal end 608*b* of linear rod 608. Bidirectional solenoid activation arm 800 is comprised of housing 801, containing electrical coils 801*a*, and cylinder 803 comprised of a solid portion, plunger 802, and a hollow portion 803*a*. Arm 800 is located in housing block 520 adjacent to cam 704. Housing 801, containing coils 801*a*, is fixed in housing block cavity 520*a*, while cylinder 803, comprising plunger 802 hollow portion 803*a*, move bidirectionally linearly through the electrical coils 801*a* and slidably in cavity 805 in housing block 520. Housing 801 is positioned to avoid contact with cam 704, but to enable cylinder 803 to slidably move in cam groove 731 of cam 704.

As shown in FIGS. 8 and 8*a*, cam 704 is a flat plate which is generally circular in shape having axial hole 710 in the center thereof which is at right angles to the plate. Cam 704 includes three distinct areas which are spaced apart about axle hole 710. The spaced areas are open area 732, slotted area 730 and closed area 733.

Open area 732, also referred to as the forked area of cam 704, has first shoulder 711 on one side thereof and second shoulder 712 on the opposite side thereof, wherein second shoulder 712 is spaced apart from and shorter than first shoulder 711.

Closed area 733 has two semicircular grooves, referred to herein as detent 707 and detent 708, formed on the outer edge thereof.

Slotted area 730, intermediate closed area 733 and open area 732, contains cam slot 730*a* which extends from the edge of cam 704 radially toward axle hole 710. Slot 730*a* consists of an open end at the edge of cam 704, parallel sides 734 and 735 and closed semicircular end 736 that connects the parallel sides. Cam slot 730*a* is sized to permit cam pin 808, located in arm slot 804 of cylinder 803, to move radially with respect to axle 705, as cam 704 is rotated about cam axle 705 by the linear motion of cylinder 803. As was previously explained, cam pin 808 does not move radially in cam slot 804 with respect to axle 705. The rotation of cam 704, however, causes the distance between pin 808 and axle 705 to change.

Curvilinear groove 731 is formed in the edge of cam 704 in slotted area 730. Groove 731 is formed between the upper and lower surfaces of cam 704. The plane of groove 731 is perpendicular to cam axle 705. As shown by the dotted line on FIG. 8, groove 731 is variable in depth and extends from closed area 733, in the vicinity of detent 707, and extends to open area 732 in the vicinity of first shoulder 711. The variable depth of groove 731 produces a curved bottom surface within the interior of cam 704 as shown by the dotted line on FIG. 8. Groove 731 is sized to permit cylinder 803 to be slidably positioned within groove 731 between the edge of cam 704 and cam axle 705 as shown in FIGS. 3–7. Cylinder 803 slides within groove 731 as cam 704 rotates around cam axle 705. The depth of groove 731 is sufficient to avoid contact between cylinder and the bottom of groove 731.

The rotation of cam 704 can be caused by pin 808 moving within slot 804 and against sides 734 and 735 of slot 730*a*, to thereby convert the linear motion of cylinder 803 to the rotational motion of cam 704. Cam 704 can also be rotated by handcuff key 300, as shown in FIG. 1. Curvilinear groove 731 is located in cam 704 to enable cylinder 803 to slide within groove 731 regardless of the rotational position of cam 704.

As seen in FIGS. 9, 9*a*, 10 and 10*a* cylinder 803 is a cylindrical tube comprised of hollow portion 803*a* and plunger 802. Portion 803*a* includes proximal end 806 which abuts plunger 802 and closed distal end 807. Cam pin 808 is located in cylinder intermediate proximal end 806 and distal end 807 of hollow portion 803*a*. Cam pin 808 parallel to cam axle 705 and perpendicular to the longitudinal axis of cylinder 803. As seen in FIGS. 9 and 10, cam pin 808 extends beyond the exterior surface of cylinder 803 and penetrates slot 730*a* of cam 704 to thereby establish a movable connection between activation arm 800 and cam 704. Pin 808 functions to convert linear movement of cylinder 803 to rotational motion of cam 704.

Cam pin 808 is slidably maintained within arm slot 804 in hollow portion 803*a* between biasing springs 809 and 810 which are located in the hollow interior of hollow portion 803*a* at proximal end 806 and distal end 807, respectively. Cam pin 808 is positioned between spring 809 and spring 810 perpendicular to the longitudinal axis cylinder 803.

Cam axle 705 is perpendicularly fixed to parallel cheek plates 6 and 7. Cam 704 is rotatably mounted on cam axle 705. Cam lever 610 on rod 608 is situated between first shoulder 711 and second shoulder 712 of open area 732 of cam 704. Cam 704 rotates around cam axle 705 in a plane parallel to cheek plates 6 and 7.

The locking mechanism of this invention can be, and is preferably, further comprised of a mechanical means, such as key 300, for rotating cam 704 about cam axle 705 and further comprised of detent assembly 706, including spring 718 and ball 719, acting in combination with detents 707 and 708 for maintaining the position of cam 704 with respect to cam lever 610 in either the closing position, FIG. 3, or the locked position, FIG. 4.

As seen in FIG. 5, counter clockwise rotation of cam 704 around cam axle 705, by means of cylinder 803, causes contact between cam lever 610 and the inside surface of first shoulder 711 to thereby linearly urge distal end 608*a* of rod 608 against biasing spring 618, to permit rotation of idler gear 606 in any rotational direction.

As seen in FIG. 4, clockwise rotation of cam 704 around cam axle 705, by means of cylinder 803, causes contact between the cam lever 610 and the inside surface of second shoulder 712 to thereby linearly urge proximal end 608*b* of rod 608 against the teeth of idler gear 606 to prevent rotation of idler gear 606 in any rotational direction.

As seen in FIG. 3, positioning cam 704 in the closing position permits contact between cam lever 610 and the inside surface of first shoulder 711, but does not urge distal end 608*a* of rod 608 against biasing spring 618, to permit closing rotation of idler gear 606 while preventing opening rotation of idler gear 606.

Figure 6:
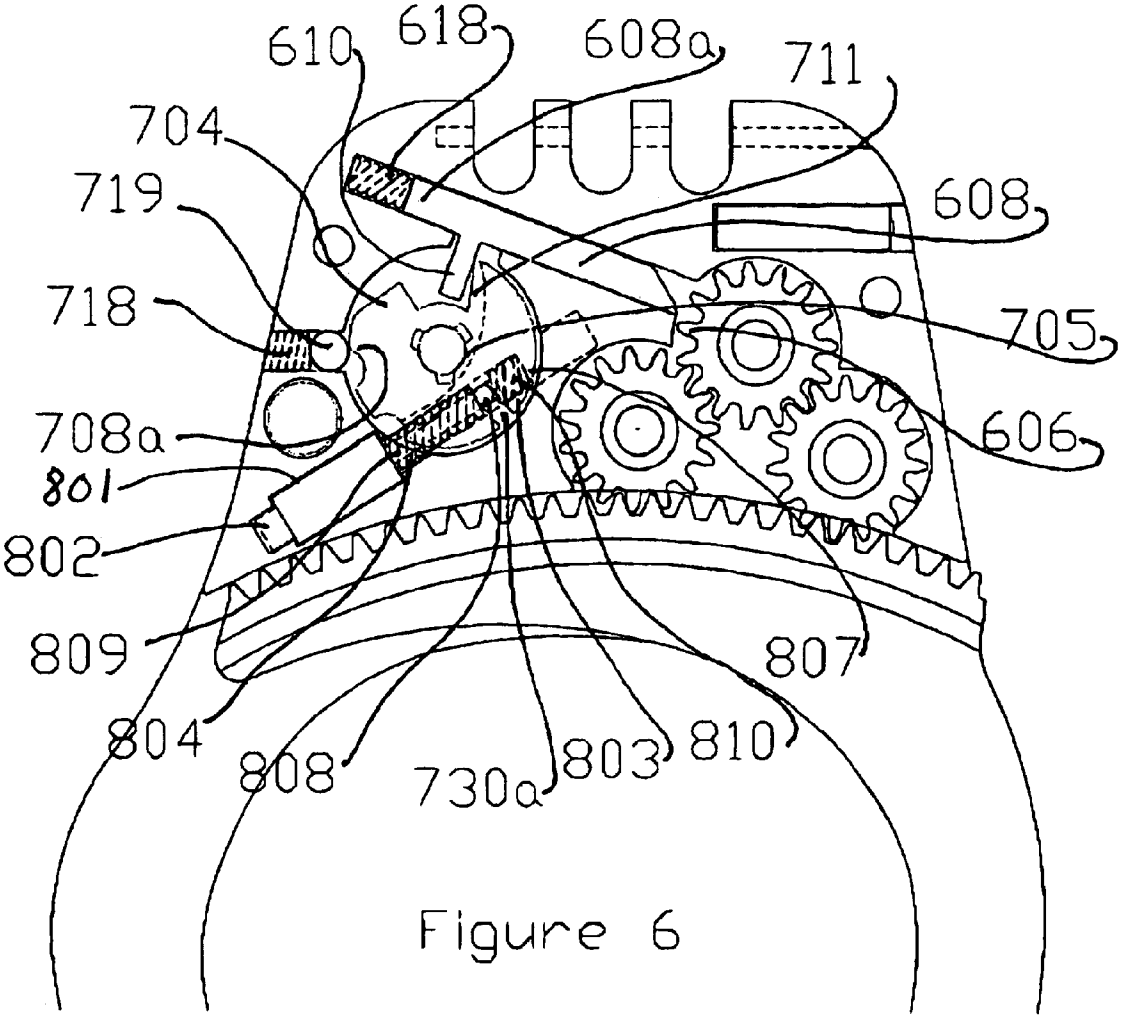
FIG. 6 is a plan view of a handcuff of this invention having an exterior plate removed to reveal a part of the swing arm, interior plate, the machinery spaces, the operating mechanism, and the electro-mechanical locking mechanism configured in the free position by a mechanical key. Compare FIGS. 4, 5 and 6.

As shown in FIG. 6, rotation of cam 704 about cam axle 705 in counter clock wise direction by a handcuff key, such as key 300, from the electronically derived locked position, FIG. 4, causes cam pin 808 to move linearly in arm slot 804 and change position in cam slot 730*a*. These movements cause the compression of biasing spring 810 at end 807 of cylinder 803 and contact between cam lever 610 and the inside surface of the first shoulder 711 to thereby move rod 608 against biasing spring 618 at distal end 608*a*.

Figure 7:
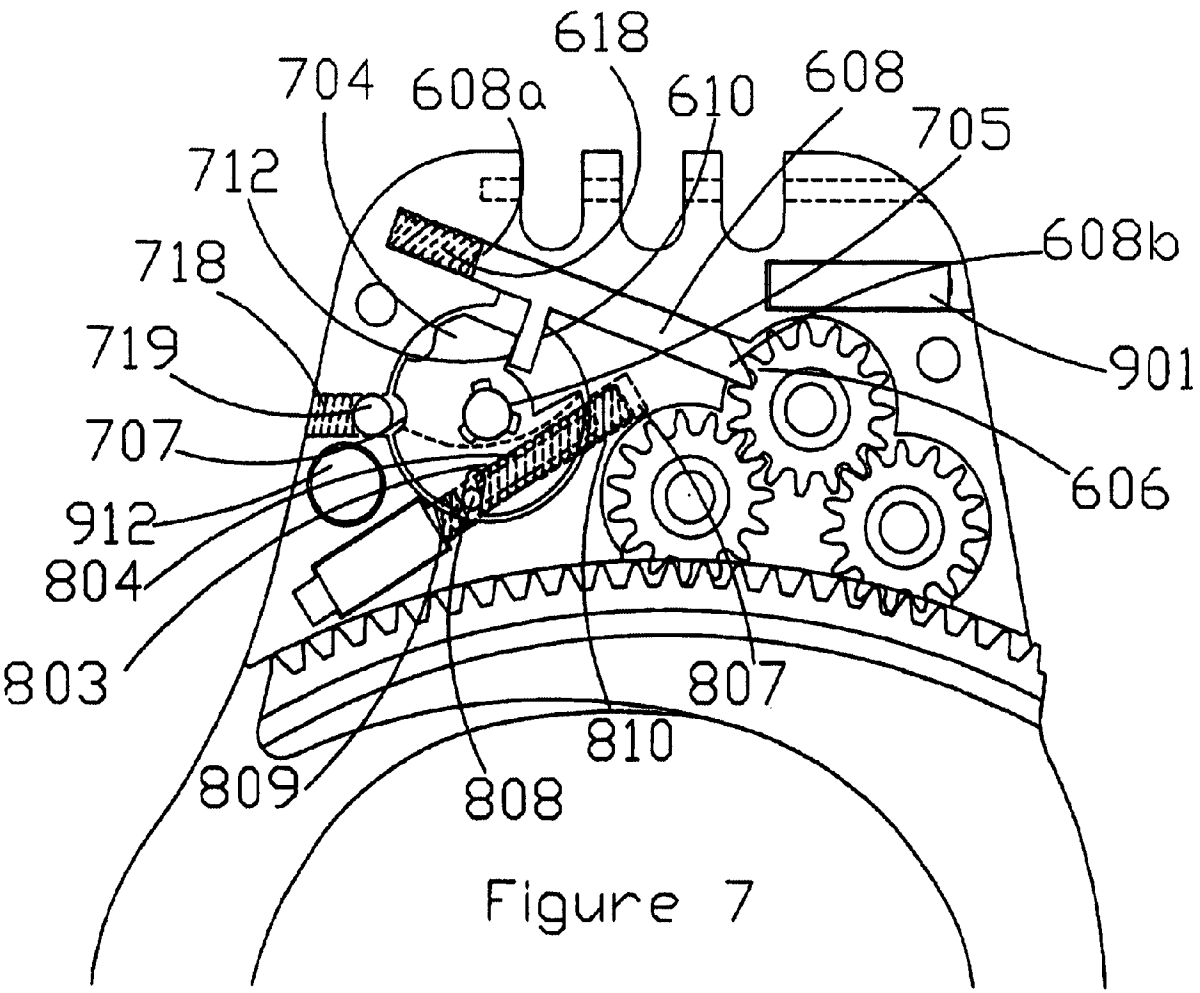
FIG. 7 is a plan view of a handcuff of this invention having an exterior plate removed to reveal a part of the swing arm, interior plate, the machinery spaces, the operating mechanism, and the electro-mechanical locking mechanism configured in the locked position by a mechanical key. Compare FIGS. 3 and 7.

As shown in FIG. 7, rotation of cam 704 about cam axle 705 in clockwise direction by a handcuff key, such as key 300, from the electronically derived closing position, FIG. 3, causes cam pin 808 to move linearly in arm slot 804 and to change position in cam slot 730*a*. These movements cause the compression biasing spring 809 at end 806 of cylinder 803 and contact between cam lever 610 and the inside surface of second shoulder 712 to thereby prevent linear movement of rod 608 against biasing spring 618 at distal end 608*a*.

Refer now to FIGS. 2 and FIGS. 3–10. Every detail of FIG. 3–10 is not described, but notice that the reference numerals employed in FIG. 3 are 500 numbers greater than the numerals shown in FIGS. 1 and 2. Thus, for example, reference numeral 106 in FIG. 2 corresponds to reference numeral 606 in FIG. 3. Specific reference is made to a numeral in FIGS. 3–10 only if clarification is believed to be served by such reference.

As mentioned above, this invention provides an apparatus useful as a handcuff which, with two additions, is described in U.S. Pat. No. 6,568,224 and U.S. application Ser. No. 10/394,668. The first addition is a bi-directional solenoid with an associated power source and a UHF receiver. The second addition is a modification of yoke 204 as described in the '224 patent. The modified yoke, now referred to as cam 804, enables the use of the bi-directional solenoid.

To prevent any rotation of the gears in any direction the locking mechanism is configured in the locked position as shown in FIG. 4. It is to be understood that the swing arm, if not engaged with a tooth of a gear as shown in FIG. 4, can move until it contacts a gear tooth, then it cannot move. The locked position, as shown in FIG. 4, resists any force placed by a tooth of idler gear 606 moving in the closing rotational direction on the slant side of the wedge of proximal end 608*b* to compress spring 618.

The locking mechanism of this invention, shown in cavity 507, is comprised of detent assembly 706, cam axle 705 and cam 704 in operable combination with bidirectional solenoid activation arm 800 which is mounted in the machinery space and partially internal to cam 704.

Referring to FIG. 8, cam 704 is in the shape of a circular plate pierced in the middle by axle hole 710, which is at right angles to the plate. The circular shape of cam 704 is modified in that material has been removed therefrom in three distinct spaced areas around the periphery of cam 704. The spaced areas, which are about 120 degrees apart, are open area 732, slotted area 730 and closed area 733.

Open area 732, also referred to as the forked area of cam 704, has first shoulder 711 on one side of opening 732 and second shoulder 712 on the opposite side of opening 732. Second shoulder 712 is spaced apart from and shorter than first shoulder 711.

Cam 704 contains two semicircular grooves 707 and 708 located on the outer edge of closed area 733. The grooves are referred to herein as detents.

Slotted area 730, intermediate closed area 733 and forked area 732, contains cam slot 730*a* formed in the edge of cam 704 and extending radially toward axle hole 710. Cam slot 730*a* is comprised of first portion 734, second portion 735 and semicircular end 736 which connects portions 734 and 735. Slot 730*a* is sized to slidably receive cam pin 808, shown in FIG. 9 to be located in cylinder 803. Slot 730*a* enables pin 808 to change the distance from it to axle hole 710, as cam 704 rotates about cam axle 705.

Groove 731 is formed in the edge of cam 704 in slotted area 730 between closed area 733 and forked area 732. As seen in FIGS. 3–8, groove 731 is variable in depth and is sized to slideably receive and contain cylinder 803. The variable depth of groove 731 produces a curvilinear bottom between the edge of cam 704 in area 730 and axle hole 710. Cylinder 803 slides within groove 731, but does not contact the curvilinear bottom of groove 731. Groove 731 also allows a handcuff key to rotate cam 704 about cam axle 705 without moving cylinder 803.

Cam 704 further contains three linear pockets 714, 715 and 716 formed on the surface of axle hole 710. Each of the pockets 714, 715 and 716 is parallel to cam axle 705. The pockets are spaced at intervals around the surface of axle hole 710. There must be at least one such linear pocket. Multiple pockets can be spaced at intervals greater or less than 120-degree intervals.

Cam axle 705 is perpendicularly fixed to a cheek plate in the machinery space. Cam 704 is rotatably mounted on cam axle 705 so that cam lever 610 on linear rod 608 is situated between first shoulder 711 and second shoulder 712 in area 732. Cam 704 rotates around cam axle 705 in a plane parallel to the cheek plates.

Referring to FIGS. 9 and 10, bidirectional solenoid 800 is comprised of housing 801 containing electrical coils 801*a*, and cylinder 803 containing plunger 802 and hollow portion 803*a*. Bidirectional solenoid 800 is mounted in the machinery space wherein cylinder 803 is substantially completely slidably maintained in groove 730*a*, and housing 801 with electrical coils 801*a* are fixed in housing block cavity 520*a*.

Cylinder 803 is a tube comprised of plunger 802 and hollow portion 803*a* having proximal end 806 abutting plunger 802 and distal end 807 at the closed end of portion 803*a*. Arm slot 804 is formed in the wall of hollow portion 803*a* parallel to the longitudinal axis of cylinder 803. Springs 809 and 810 are located within the hollow portion 803*a*, wherein spring 809 is positioned in proximal end 806 and spring 810 is positioned in distal end 807.

Cam pin 808 is located intermediate springs 809 and 810 in a position parallel to cam axle 705. Cam pin 808 extends beyond the outer surface of cylinder 803 and is adapted to slide in slot 730*a* of cam 704. Cam pin 808 movably connects solenoid activation arm 800 and cam 704 and functions to convert linear motion of cylinder 803 to rotational motion of cam 704. Cam pin 808 also moves within slot 804 of cylinder 803. Springs 809 and 810 operate to maintain pin 808 in cam slot 730*a*.

As seen in FIGS. 3, 8, 9 and 10, energizing coil 801*a* by means of an electrical current creates a magnetic force between coils 801*a* and plunger 802 which causes cylinder 803 to linearly move cam pin 808 in a first direction against first portion 734 of slot 730*a* of cam 704 to thereby convert the linear motion of cam pin 808 to rotational motion of cam 704 in the closing direction. This causes contact between cam lever 610 and the inside surface of first shoulder 711 to thereby linearly urge rod 608 against biasing means 618 at distal end 608*a* of rod 608, but not by an amount sufficient to prevent contact between the proximal end 608*b* of rod 608 and the teeth of idler gear 606.

As seen in FIGS. 4, 9, and 10 energizing coil 801*a* by means of an electrical current creates a magnetic force between coils 801*a* and plunger 802 and causes cylinder 803 to linearly move cam pin 808 in a second direction against second portion 735 of slot 730*a* of cam 704 to thereby convert the linear motion of cam pin 808 to rotational motion of cam 704 in a locking direction. This causes contact between cam lever 610 and the inside surface of second shoulder 712 to thereby linearly urge proximal end 608*b* of rod 608 against the teeth of idler gear 606.

As seen in FIGS. 5, 9 and 10 energizing coil 801*a* by means of an electrical current creates a magnetic force between coils 801*a* and plunger 802 and causes cylinder 803 to linearly move cam pin 808 in the mentioned first direction against the first portion 734 of slot 730*a* of cam 704 to thereby convert the linear motion of cam pin 808 to rotational motion of cam 704 about cam axle 705 in the closing direction. This causes contact between cam lever 610 and the inside surface of the first shoulder 711 to move rod 608 against biasing means 618 at distal end 608*a* of rod 608 by an amount sufficient to prevent contact between proximal end 608*b* of rod 608 and the teeth of idler gear 606.

As seen in FIG. 6, mechanical rotation of cam 704 about cam axle 705 in the counter clock wise direction, through the use of key 300, from the locked electronic position, FIG. 4, causes cam pin 808 to travel linearly in arm slot 804 to compress spring 810 at distal end 807 of cylinder 803. Additionally, mechanical rotation of cam 704 about cam axle 705 causes contact between cam lever 610 and the inside surface of the first shoulder 711 to linearly urge the distal end 608*a* of rod 608 against spring 618 by an amount sufficient to prevent contact between proximal end 608*b* of rod 608 and the teeth of idler gear 606.

As seen in FIG. 7, mechanical rotation of cam 704 about cam axle 705 in the clock wise rotational direction, through the use of key 300, from the closing electronic position, FIG. 3, causes cam pin 808 to travel linearly in arm slot 804 to compress spring 809 at the proximal end of cylinder 803. Additionally, rotation of cam 704 about cam axle 705 in the clock wise direction causes contact between cam lever 610 and the inside surface of the second shoulder 712 to urge the proximal end 608*b* of rod 608 against the teeth of the idler gear 606 to prevent rotation of idler gear 606.

The locking mechanism of this invention can further include a power source comprising battery 901, located in housing block 520, a UHF RF sensor module 912, which interprets the received RF signal and activates cam solenoid 800 in the correct direction, and a remote UHF RF transmitter.

4. OPERATION OF THE INVENTION

The basic operation and cooperation of the various elements of the operating mechanism and the locking mechanism of this invention have been discussed.

The activation of the remote transmitter generates an opening or a closing UHF RF signal. RF sensor module 912 interprets the received RF signal and activates bidirectional solenoid 800 in the correct direction. As shown in FIGS. 3 and 9, an opening signal causes the bidirectional solenoid 800 to extend cylinder 803 out of housing 801 toward rod 608. Springs 809 and 810 position cam pin 808 within slot 804 to urge against first portion 734 of 730*a* of cam 704. Cam 704, in response to the applied force of cam pin 808, rotates in a counter clockwise direction. Similarly, as shown in FIGS. 4 and 10, a closing signal causes the bidirectional solenoid 800 to retract cylinder 803 into housing 801 away from rod 608. Springs 809 and 810 position cam pin 808 within slot 804 to urge against second portion 735 of slot 730*a* of cam 704. Cam 704, in response to the applied force of pin 808, rotates in a clockwise direction.

In all electronic operating modes, bias springs 809 and 810 operate to position cam pin 808 to apply sufficient force against sides 734 and 735 in slot 730*a*, to rotate cam 704 about cam axle 705, and to compress detent spring 718.

In a first electronic operational mode, the force applied by cam pin 808 against side 734 of cam slot 730*a* is sufficient to compress detent spring 718 to enable detent ball 719 to move out of detent 707, the "locked position" as shown in FIG. 4, and to cause cam 704 to rotate counter clockwise about cam axle 705, so that ball 719 will move into detent 708 to thereby place the handcuffs in the "closing position" as shown in FIG. 3. In this mode the swing arm can only move in the closing rotational direction.

In a second electronic operational mode, the force applied by cam pin 808 against side 735 of cam slot 730*a* is sufficient to compress detent spring 718 to enable detent ball 719 to move out of detent 708, the "closing position" as shown in FIG. 3, and to cause cam 704 to rotate clockwise about cam axle 705, so that ball 719 will move into detent 707 to thereby place the handcuffs in the "locked position" as shown in FIG. 4. In this mode the swing arm cannot move in any rotational direction.

In a third electronic operational mode, the force applied by cam pin 808 against side 734 of cam slot 730*a* is sufficient to compress detent spring 718 to enable detent ball 719 to move out of detent 708, the "closing position" as shown in FIG. 3, and is also sufficient, by means of the inside surface of first shoulder 711 of open area 732 against lever 610, to compress spring 618 at distal end 608*a* of rod 608, and is still further sufficient to cause cam 704 to rotate counter clockwise about cam axle 705 so that ball 719 will move onto ramp 708*a* to thereby place the handcuffs in the "free position" as shown in FIG. 5. In this mode the swing arm can move in the closing and in the opening rotational direction.

Key 300 can be employed to rotate cam 704 about cam axle 705. This method can be of particular utility in the event of failure of the activation solenoid 800 or power source 901. It is left to be stated that, after the handcuff has been positioned in the locked position, FIG. 4, as above described, key 300 can be used to rotate cam 704 about the cam axle 705. As shown in FIG. 6, mechanical counter clockwise rotation of cam 704 from the locked electronic position causes cam pin 808 to travel linearly in arm slot 804 to compress biasing spring 810 at distal end 807 of hollow portion 803*a* of cylinder 803. As biasing spring 810 is compressed by cam pin 808, biasing spring 809 expands by the same amount to maintain contact with cam pin 808. At all times while key 300 is rotating cam 704 counterclockwise about axle 705 the position of cylinder 803 remains in the electronically locked position. Also as shown in FIG. 6, mechanical counter clockwise rotation of cam 704 about cam axle 705 causes contact between cam lever 610 and the inside surface of first shoulder 711 to thereby urge rod 608 to compress spring 618 at distal end 609 of rod 608 thus allowing the swing arm to move in any rotational direction.

Once key 300 ceases to rotate cam 704 about cam axle 705, cam pin 808 no longer compresses biasing spring 810. The pressure of detent spring 718 on detent ball 719 on ramp 708*a* will force cam 704 to rotate about cam axle 705 such that detent ball 719 is centered in detent 708 to prevent biasing spring 810 from returning to the electronic locked position. The new position is similar to the electronic closing position, FIG. 3.

Similarly, after the handcuff has been positioned in the closing position, FIG. 3, as above described, key 300 can be used to rotate cam 704 about the cam axle 705. As shown in FIG. 7, mechanical clockwise rotation of cam 704 from the closing electronic position causes cam pin 808 to travel linearly in arm slot 804 to compress biasing spring 809 at proximal end 806 of hollow portion 803*a* of cylinder 803. As biasing spring 809 is compressed by cam pin 808, biasing spring 810 expands by the same amount to maintain contact with cam pin 808. At all times while key 300 is rotating cam 704 clockwise about cam axle 705, the position of cylinder 803 remains in the electronically positioned closing position. The pressure of detent spring 718 on detent ball 719 is such that detent ball 719 is centered in detent 707 and will prevent biasing spring 809 from returning to the electronic closing position.

Also as shown in FIG. 7, mechanical clockwise rotation of cam 704 about cam axle 705 causes contact between cam lever 610 and the inside surface of second shoulder 712 to thereby urge proximal end 608*b* of rod 608 against the teeth of the idler gear 606 thus preventing the swing arm from moving in any rotational direction.

What is claimed is:

1. An apparatus comprised of at least a first gear, a swing arm, a rod, a cam and an actuation arm wherein:

said first gear is rotatably attached to a first hub which is perpendicularly affixed to a planar base, said first gear is equipped with a first set of teeth and is adapted to rotate around said first hub in a plane parallel to said planar base;

said swing arm is rotatably attached to said planar base and is equipped with a second set of teeth adapted for intermeshing contact with said first set of teeth upon rotation of said first gear around said first hub;

said rod is slidably mounted on said planar base and is adapted to control the rotation of said first gear around said first hub;

said cam is rotatably attached to a cam axle which is perpendicularly affixed to said planar base, and is equipped with means to linearly move said rod upon rotation of said cam around said cam axle; and said actuation arm is affixed to said planar base and is equipped with means to rotate said cam around said cam axle;

further wherein said cam is a substantially circular plate having a first slot, a first groove, shoulder means for linearly moving said rod, a top surface and a bottom surface;

said first slot penetrates said cam from said top surface to said bottom surface and extends radially from the edge of said cam toward said cam axle;

said first groove is formed in at least a peripheral portion of said cam between said top surface and said bottom surface, extends from the edge of said cam toward said cam axle, and intersects said first slot;

said actuation arm is comprised of a housing and a cylinder;

said housing is fixed to said planar base and is positioned thereon to avoid contact with said cam, said housing has two open ends and a hollow interior wherein at least one coil, adapted to conduct an electric current, is positioned in said hollow interior;

said cylinder includes a solid portion and hollow portion having a closed end, wherein said solid portion is adapted to longitudinally slide within said at least one coil in said hollow interior of said housing, and said hollow portion is slidably positioned within said first groove of said cam;

said hollow portion of said cylinder contains a second slot, a first biasing spring, a second biasing spring and a pin positioned between said first biasing spring and said second biasing spring;

said second slot is formed in opposite walls of said hollow portion of said cylinder, is parallel to the longitudinal axis of said cylinder, and intersects said first slot when said cylinder is positioned in said in said first groove;

said pin is positioned in said hollow portion of said cylinder perpendicular to said longitudinal axis of said cylinder and extends from said second slot into said first slot, whereby linear movement of said cylinder is converted by said pin to rotational movement of said cam to thereby linearly move of said rod to control rotation of said at least first gear.

2. The apparatus of claim 1 further comprised of battery means for supplying said electric current to said at least one coil to thereby cause linear movement of said cylinder.

3. The apparatus of claim 2 further comprised of remote means to cause said battery to supply said electric current to said at least one coil.

4. The apparatus of claim 1 is a handcuff.

5. The handcuff of claim 4 wherein said pin extends to said top surface and to said bottom surface of said improved cam.

6. The handcuff of claim 5 further comprised of a second gear rotatably attached to a second hub which is perpendicularly affixed to said planar base, said second gear is equipped with a third set of teeth and is adapted to rotate around said second hub in a plane parallel to said planar base;

said third set of teeth is adapted for intermeshing contact with said second set of teeth on said swing arm upon rotation of said second gear around said second hub.

7. The handcuff of claim 6 further comprised of a third gear rotatably attached to a third hub which is perpendicularly affixed to said planar base, said third gear is equipped with a fourth set of teeth and is adapted to rotate around said third hub in a plane parallel to said planar base;

said fourth set of teeth is adapted for intermeshing contact with said first set of teeth on said first gear and said third set of teeth on said second gear upon rotation of said first gear around said first hub and said second gear around said second hub.

8. The handcuff of claim 7 wherein said rod is adapted to contact said fourth set of teeth on said third gear to control the rotation of said first gear around said first hub, said second gear around said second hub and said third gear around said third hub.

9. The apparatus of claim 1 wherein said improved cam is adapted to receive a key means to permit mechanical rotation of said improved cam.

10. The apparatus of claim 1 wherein said rod is adapted to contact said first set of teeth on said first gear.

11. The apparatus of claim 6 wherein said rod is adapted to contact said third set of teeth on said second gear.

12. An improved handcuff comprised of at least a first gear, a swing arm, a rod and a cam wherein:

said first gear is rotatably attached to a first hub which is perpendicularly affixed to a planar base, said first gear is equipped with a first set of teeth and is adapted to rotate around said first hub in a plane parallel to said planar base;

said swing arm is rotatably attached to said planar base and is equipped with a second set of teeth adapted for intermeshing contact with said first set of teeth upon rotation of said first gear around said first hub;

said rod is slidably mounted on said planar base and is adapted to control the rotation of said first gear around said first hub; and said cam is rotatably attached to a cam axle which is perpendicularly affixed to said planar base, said cam is equipped with means to linearly move said rod upon rotation of said cam around said cam axle;

wherein the improvement of said apparatus is comprised of an improved cam and an actuation arm in combination with said rod and said at least first gear;

said improved cam is a substantially circular plate attached to said cam axle, said improved cam, which is adapted to rotate around said cam axle in a plane parallel to said planar base, includes a first slot, a first groove, shoulder means for linearly moving said rod, a top surface and a bottom surface;

said first slot penetrates said improved cam from said top surface to said bottom surface thereof and extends radially from the edge of said improved cam toward said cam axle;

said first groove is formed in at least a peripheral portion of said improved cam between said top surface and said bottom surface of said improved cam and extends from the edge of said improved cam toward said cam axle, said first groove intersects said first slot;

said actuation arm is comprised of a housing and a cylinder;

said housing is fixed to said planar base and is positioned thereon to avoid contact with said improved cam, said housing has two open ends and a hollow interior wherein at least one coil, adapted to conduct an electric current, is positioned in said hollow interior;

said cylinder includes a solid portion and hollow portion having a closed end, wherein said solid portion is adapted to longitudinally slide within said at least one coil in said hollow interior of said housing, and said hollow portion is slidably positioned within said first groove of said improved cam;

said hollow portion of said cylinder contains a second slot, a first biasing spring, a second biasing spring and a pin positioned between said first biasing spring and said second biasing spring;

said second slot, which is formed in opposite walls of said hollow portion of said cylinder, is parallel to the longitudinal axis of said cylinder, said second slot intersects said first slot when said cylinder is positioned in said in said first groove;

said pin is positioned in said hollow portion of said cylinder perpendicular to said longitudinal axis of said cylinder and extends from said second slot into said first slot, whereby linear movement of said cylinder is converted by said pin to rotational movement of said improved cam to thereby linearly move of said rod to control rotation of said at least first gear.

* * * * *